US010605426B2

(12) United States Patent
Qiu et al.

(10) Patent No.: US 10,605,426 B2
(45) Date of Patent: Mar. 31, 2020

(54) LED LIGHT SOURCE HIGH-BEAM AND LOW-BEAM INTEGRATED AUTOMOBILE LAMP MODULE WITH ADB FUNCTION

(71) Applicant: HASCO VISION TECHNOLOGY CO., LTD., Shanghai (CN)

(72) Inventors: Zhiping Qiu, Shanghai (CN); He Zhu, Shanghai (CN); Weigang Gong, Shanghai (CN)

(73) Assignee: HASCO VISION TECHNOLOGY CO., LTD., Shanghai (CN)

( * ) Notice: Subject to any disclaimer, the term of this patent is extended or adjusted under 35 U.S.C. 154(b) by 0 days.

(21) Appl. No.: 16/462,919

(22) PCT Filed: May 8, 2017

(86) PCT No.: PCT/CN2017/083410
§ 371 (c)(1),
(2) Date: May 21, 2019

(87) PCT Pub. No.: WO2018/133250
PCT Pub. Date: Jul. 26, 2018

(65) Prior Publication Data

US 2020/0063939 A1 Feb. 27, 2020

(30) Foreign Application Priority Data

Jan. 19, 2017 (CN) ..... 2017 1 0043979
Jan. 19, 2017 (CN) ..... 2017 2 0074777

(51) Int. Cl.
*F21S 41/32* (2018.01)
*F21S 41/147* (2018.01)
(Continued)

(52) U.S. Cl.
CPC ..... *F21S 41/322* (2018.01); *F21S 41/143* (2018.01); *F21S 41/147* (2018.01); *F21S 41/151* (2018.01);
(Continued)

(58) Field of Classification Search
CPC ..... F21S 41/30–338; F21S 41/20–295; F21S 45/43
See application file for complete search history.

(56) References Cited

U.S. PATENT DOCUMENTS 10,352,523 B2 * 7/2019 Nishimura ..... F21S 41/40
10,451,238 B2 * 10/2019 Meyrenaud ..... F21S 41/19
(Continued)

FOREIGN PATENT DOCUMENTS

WO WO-2018133250 A1 * 7/2018 ..... F21S 41/24
WO WO-2019100240 A1 * 5/2019 ..... F21V 5/00

*Primary Examiner* — Mariceli Santiago
(74) *Attorney, Agent, or Firm* — CBM Patent Consulting, LLC

(57) ABSTRACT

Disclosed is an LED light source high-beam and low-beam integrated automobile lamp module with an ADB function, comprising a condenser (1), high-beam LED light sources (2), a low-beam LED light source (3), an auxiliary reflector (4), a reflector (5) and a lens (6). A block cavity structure (7) is arranged in the middle of a left or right portion of the condenser (1), and the number of the high-beam LED light sources (2) is at least two. An LED light source corresponding to a rear end of the block cavity structure on the condenser (1) is in a lit-up state when being in a full-high-beam working state, and light emitted thereby is transmitted by the block cavity structure and then is emitted forwards, so as to form a part of a high-beam light shape.

13 Claims, 10 Drawing Sheets

(51) Int. Cl.

| | |
|---|---|
| ***F21S 41/365*** | (2018.01) |
| ***F21S 41/143*** | (2018.01) |
| ***F21S 41/255*** | (2018.01) |
| ***F21S 41/151*** | (2018.01) |
| ***F21S 45/43*** | (2018.01) |
| *F21W 102/14* | (2018.01) |

(52) U.S. Cl.
CPC ..... *F21S 41/255* (2018.01); *F21S 41/365* (2018.01); *F21S 45/43* (2018.01); *F21W 2102/14* (2018.01)

(56) References Cited

U.S. PATENT DOCUMENTS

| | | | | |
|---|---|---|---|---|
| 2007/0115679 | A1* | 5/2007 | Alcelik ..... | F21S 41/255<br>362/518 |
| 2017/0198877 | A1* | 7/2017 | Suwa ..... | F21S 41/27 |

* cited by examiner

LED LIGHT SOURCE HIGH-BEAM AND LOW-BEAM INTEGRATED AUTOMOBILE LAMP MODULE WITH ADB FUNCTION

BACKGROUND OF THE INVENTION

1. Technical Field

The invention relates to automobile lamps, in particular to a LED light source high-beam and low-beam integrated automobile lamp module with an ADB function.

2. Description of Related Art

With the continuous development of LED light sources applied to automobile lamps, high-beam and low-beam automobile lamp modules with various properties are emerging one after another, wherein integrated high-beam and low-beam automobile lamp modules having a low cost, a small size, a simple structure and complete functions are very popular on the market and have become one development direction of high-beam and low-beam automobile lamp modules.

Driving safety is drawing more and more attention from people due to the fact that a greater number of driving accidents are caused by improper use of high beams. Automobile lamp modules with an ADB (Adaptive Driving Beam) function can solve the contradiction between high beams and low beams to a certain degree, so as to ensure the good visibility of automobiles equipped with the automobile lamp modules and to protect the drivers of other automobiles against dazzling. The ADB function based on intelligent control can fulfill real-time control over the illumination area and illumination brightness through independent control over each LED, thereby effectively protecting other automobiles and passengers against dazzling.

There are nowadays three main types of automobile lamp modules with the ADB function: as for one type of modules, a light shield is used for shielding light to form an ADB light shape, but such modules have to be equipped with parts such as the light shield and an electromagnetic valve, thereby being complex in structure, large in size and high in cost; as for another type of modules, an ADB light shape is formed by lighting off part of LEDs in a high-resolution LED matrix, but such modules require a large number of LED light sources, thereby being high in cost, and also have to be equipped with parts such as the light shield, thereby being limited in size and complex in structure; as for modules of a reflecting surface matrix type, each reflecting surface corresponds to one LED light source and one part of the light shape, and all the light shape parts are superimposed to form the ADB light shape; however, such modules are limited by the structure of the reflecting surfaces, thereby being large in size and complex in structure.

From the above description, existing automobile lamp modules with the ADB function have the drawbacks of being high in cost, complex in structure, large in size, low in integration degree and incomplete in function.

BRIEF SUMMARY OF THE INVENTION

To overcome the above drawbacks, the technical issue to be settled by the invention is to provide an LED light source high-beam and low-beam integrated automobile lamp module with an ADB function. The LED light source high-beam and low-beam integrated automobile lamp module with the ADB function has few parts and a low cost and fulfills the ADB function, thereby having complete functions and being higher in integration degree.

The technical solution of the LED light source high-beam and low-beam integrated automobile lamp module with the ADB function of the invention is as follows.

The LED light source high-beam and low-beam integrated automobile lamp module with the ADB function comprises:

a condenser (1) made from a transparent material;

high-beam LED light sources (2) and a low-beam LED light sources (3) which are arranged on a rear side, namely an incident light side, of the condenser (1);

a reflector (5) and a lens (6) respectively arranged on a front upper portion of the condenser (1), namely a front upper portion of an emergent light side, and a front side of the condenser (1). The LED light source high-beam and low-beam integrated automobile lamp module with the ADB function is characterized in that:

A block cavity structure (7) provided with an opening in an upper portion is arranged on a left or right portion of the condenser (1);

the block cavity structure is a quasi-polygon;

an inner rear end face (7-1) and an inner middle end face (7-2) of the block cavity structure are flat faces, and the inner rear end face of the block cavity structure is an end face of the incident light side;

an outer front end face (1-3) of the condenser (1) is a flat face or an arc face;

an inner front end face (7-3), namely an end face close to the lens (6), of the block cavity structure is a flat face or an arc face, which is identical with the outer front end face of the condenser (1) in shape and is matched with the outer front end face of the condenser (1).

The LED light source high-beam and low-beam integrated automobile lamp module with the ADB function of the invention is characterized in that:

An acute angle is formed at a joint of the inner rear end face (7-1) and the inner middle end face (7-2) of the block cavity structure on the condenser (1), so that a clear ADB cut-off line is formed.

The LED light source high-beam and low-beam integrated automobile lamp module with the ADB function of the invention is characterized in that:

the number of the high-beam LED light sources (2) is 2-5.

The LED light source high-beam and low-beam integrated automobile lamp module with the ADB function of the invention is characterized in that:

the number of the high-beam LED light sources (2) is 2-3.

The LED light source high-beam and low-beam integrated automobile lamp module with the ADB function of the invention is characterized in that:

of all the high-beam LED light sources (2), the high-beam LED light source located at a rear end of the block cavity structure (7) arranged on the condenser (1) and provided with the opening in the upper portion can be independently lit up or lit off.

LED light source high-beam and low-beam integrated automobile lamp module with the ADB function of the invention is characterized in that:

At the rear end of the condenser (1), the high-beam LED light source corresponding to the block cavity structure (7) located on the condenser (1) and provided with the opening in the upper portion is in a lit-up state when being in a full-high-beam working state, and light emitted thereby is transmitted by the block cavity structure and then is emitted forwards, so as to form a part of a high-beam light shape;

at the rear end of the condenser (1), the high-beam LED light source corresponding to the block cavity structure located on the condenser (1) and provided with the opening in the upper portion is in an off state when being in an ADB working state, the other LED light sources are lit up, and light is fully reflected and is then emitted forwards when being irradiated on a side face of the block cavity structure, so as to form an ADB light shape.

The LED light source high-beam and low-beam integrated automobile lamp module with the ADB function of the invention is characterized in that:

the condenser (1) is applied to a left automobile lamp, and the block cavity structure is arranged on a left portion of the condenser corresponding to the left automobile lamp.

The LED light source high-beam and low-beam integrated automobile lamp module with the ADB function of the invention is characterized in that:

the condenser (1) is applied to a right automobile lamp, and the block cavity structure is arranged on a right portion of the condenser corresponding to the right automobile lamp.

The LED light source high-beam and low-beam integrated automobile lamp module with the ADB function of the invention is characterized in that:

the condenser (1) is applied to a left or right automobile lamp, and when the number of the high-beam LED light sources (2) is an even number such as 2 or 4, an inner side face, close to the middle of the condenser, of the block cavity structure is at least located on a left or right side of a midline between two high-beam LED light sources (2);

in this way, when the block cavity structure is arranged on the right portion of the condenser, light emitted by the left high-beam LED light source is fully reflected on the inner side face, close to the middle of the condenser, of the block cavity structure on the right portion of the condenser; or when the block cavity structure is arranged on the left portion of the condenser, light emitted by the right high-beam LED light source is fully reflected on the inner side face, close to the middle of the condenser, of the block cavity structure on the left portion of the condenser.

The LED light source high-beam and low-beam integrated automobile lamp module with the ADB function of the present invention is characterized in that:

the condenser (1) is applied to a left or right automobile lamp, and when the number of the high-beam LED light sources (2) is an odd number such as 3 or 5, an inner side face, close to the middle of the condenser, of the block cavity structure is at least located on a left or right side of the axis of light emitted by the middle high-beam LED light source;

in this way, when the block cavity structure is arranged on the right portion of the condenser, light emitted by the middle high-beam LED light source is fully reflected by the inner side face, close to the middle of the condenser, of the block cavity structure on the right portion of the condenser; or when the block cavity structure is arranged on the left portion of the condenser, light emitted by the middle high-beam LED light source is fully reflected by the inner side face, close to the middle of the condenser, of the block cavity structure on the left portion of the condenser.

The LED light source high-beam and low-beam integrated automobile lamp module with the ADB function of the present invention is characterized in that:

when the condenser (1) is applied to a left or right automobile lamp, the distance from the inner front end face (7-3) of the block cavity structure on the left or right portion of the condenser to the outer front end face (1-3) of the condenser is 2-10 mm.

The LED light source high-beam and low-beam integrated automobile lamp module with the ADB function of the present invention is characterized in that:

the condenser (1) is made from transparent plastic or silica gel and is preferably made from PC.

The LED light source high-beam and low-beam integrated automobile lamp module with the ADB function of the present invention is characterized in that:

the block cavity structure on the condenser (1) is an irregular quasi-square hole.

The LED light source high-beam and low-beam integrated automobile lamp module with the ADB function of the present invention is characterized in that:

the block cavity structure on the condenser (1) is an irregular quasi-rectangular hole.

The LED light source high-beam and low-beam integrated automobile lamp module with the ADB function of the present invention is characterized in that:

the outer front end face of the condenser (1) is a concave arc face.

The LED light source high-beam and low-beam integrated automobile lamp module with the ADB function of the present invention is characterized in that:

an area III forming structure (1-2) is arranged on an upper portion of the condenser (1).

The LED light source high-beam and low-beam integrated automobile lamp module with the ADB function of the present invention is characterized in that:

the area III forming structure (1-2) comprises an area III breadth forming structure (1-2-1) and a 50 L dark area forming structure (1-2-3); light forming an area III is emitted by the low-beam LED light source and is then reflected by the reflector, so as to enter the area III breadth forming structure (1-2-1) first;

the 50 L dark area forming structure (1-2-3) is arranged in the light transmission direction and is in a convex triangle shape or in other shapes, and the brightness of a 50 L area in a low-beam light shape can be controlled below a certain value by the 50 L dark area forming structure.

The 50 L dark area forming structure can prevent dazzling while ensuring sufficient illumination of a low beam, so that the driver of an automobile from the opposite direction can drive normally without being affected.

The LED light source high-beam and low-beam integrated automobile lamp module with the ADB function of the present invention is characterized in that:

an end face of the area III breadth forming structure (1-2-1) is a concave arc shape or a convex arc shape.

The LED light source high-beam and low-beam integrated automobile lamp module with the ADB function of the present invention is characterized in that:

an area III brightness reduction structure (1-2-2) in a rectangular slot shape is arranged on a lower edge of one side of the area III breadth forming structure (1-2-1), and the brightness of a local part of an area III in a low-beam light shape is reduced by the area III brightness reduction structure (1-2-2), so that dazzling is prevented while sufficient illumination is provided by a low beam;

the area III brightness reduction structure (1-2-2) specifically has a length of about 2.8 mm, a width of about 0.4 mm and a height of about 0.3 mm and is used for reducing the brightness of a local part of the area III in the low-beam light shape, so that dazzling is avoided while sufficient illumination is provided by the low beam.

The LED light source high-beam and low-beam integrated automobile lamp module with the ADB function of the present invention is characterized in that:

the 50 L dark area forming structure (1-2-3) is arranged in the light transmission direction and is in a convex triangle shape or in other shapes, and the brightness of a 50 L area in a low-beam light shape can be controlled below a certain value by the 50 L dark area forming structure (1-2-3);

the 50 L dark area forming structure can prevent dazzling while ensuring sufficient illumination of a low beam, so that the driver of an automobile from the opposite direction can drive normally without being affected.

The condenser is used to light up a left or right automobile lamp and thus is generally installed on the automobile lamp in use.

The invention has the following beneficial effects:

based on the fact that light can be refracted and fully reflected in a transparent part, the block cavity structure is arranged on the condenser made from a transparent material, and an ADB light shape is formed by refraction and full reflection of light in the transparent part in the transmission process, so that the module of the invention does not need to be equipped with a special light shield, which is arranged in other modules to form an ADB light shape through light shielding;

based on the high-beam and low-beam integrated automobile lamp module, the structure of condenser is improved and optimized to fulfill the ADB function without increasing the size of the module, and thus, the module has a small size;

the LED light source high-beam and low-beam integrated automobile lamp module with the ADB function is not provided with a light shield, an electromagnetic valve or other parts, thereby having the advantage of simple structure;

the module has few parts and a low cost;

the high-beam and low-beam integrated automobile lamp module has the ADB function, thereby being complete in function and higher in integration degree.

In the figures: 1, condenser; 2, high-beam LED light source; 3, low-beam LED light source; 4, auxiliary reflector; 5, reflector; 6, lens; 7, slot-shaped or hole-shaped block cavity structure arranged on a left or right portion of the condenser (1) and provided with an opening in an upper portion; 7-1, inner rear end face of the block cavity structure, namely the end face of an incident light side; 7-2, middle end face of an inner left or right side of the block cavity structure; 7-3, inner front end face of the block cavity structure, namely the end face of an emergent light side of the lens.

An outer front end face (1-3) of the condenser (1) is a flat face or an arc face.

2-1, first high-beam LED light source; 2-2, second high-beam LED light source; 2-3, third high-beam LED light source; 1-2, area III forming structure; 1-2-1, area III breadth forming structure; 1-2-2, area III brightness reduction structure; 1-2-3, 50 L dark area forming structure; 1-3, outer front end face, where a cut-off line forming structure is formed, of the flat face or arc face of the condenser (1).

Ray 1, light emitted by high-beam light source 1; Ray 2, light emitted by high-beam light source 2; Ray 3, light emitted by high-beam light source 3.

DETAILED DESCRIPTION OF THE INVENTION

The invention is further explained below with reference to the accompanying drawings and specific embodiments.

Embodiment

Figure 2:
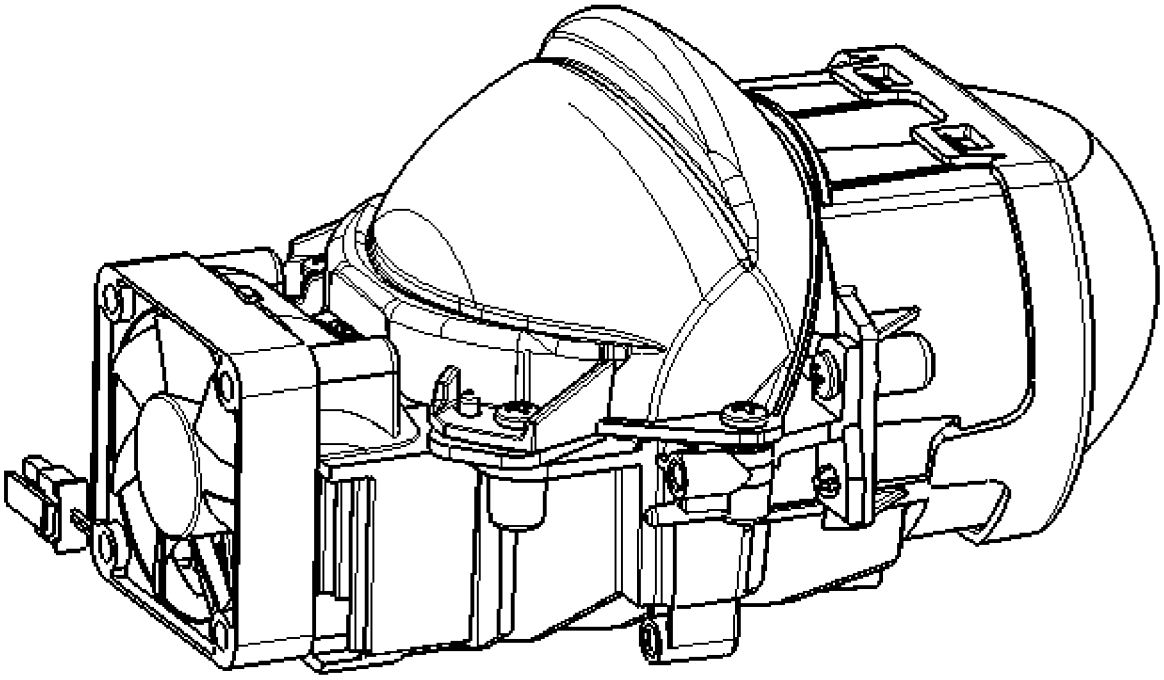
FIG. 2 is an assembled perspective view of the LED light source high-beam and low-beam integrated automobile lamp module with the ADB function of the invention.

As shown in FIG. 2, the embodiment of the invention provides an LED light source high-beam and low-beam integrated automobile lamp module with an ADB function. The LED light source high-beam and low-beam integrated automobile lamp module with the ADB function is arranged in a headlamp of an automobile to be used for illumination in a high-beam mode, low-beam mode or ADB mode.

Figure 1:
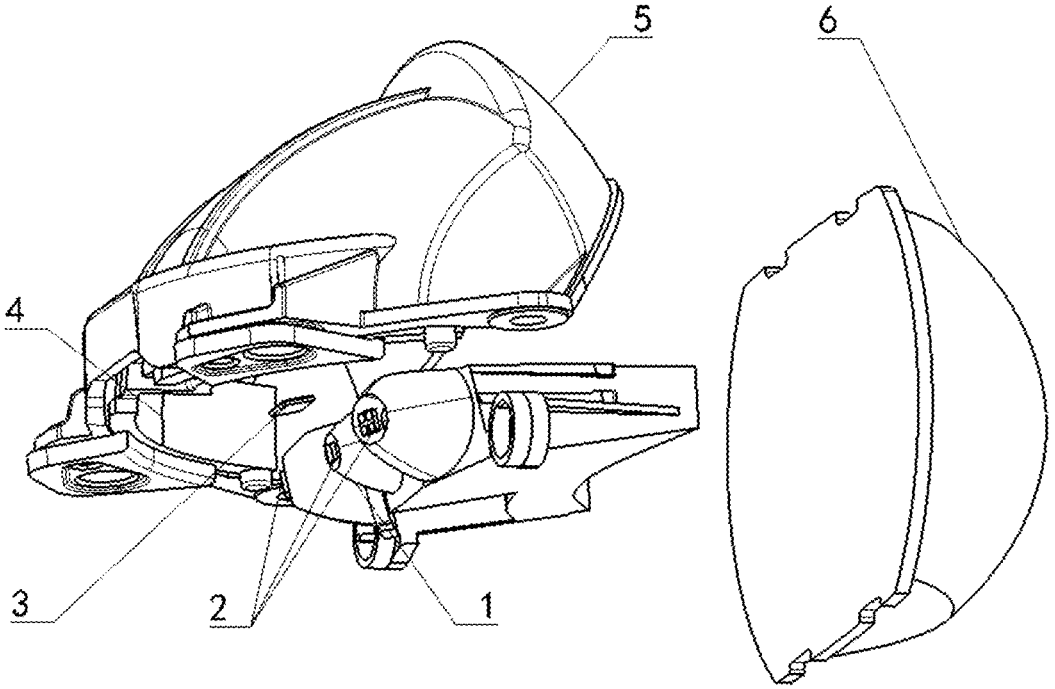
FIG. 1 is perspective view of optical elements of an LED light source high-beam and low-beam integrated automobile lamp module with an ADB function of the invention.

As shown in FIG. 1, optical elements of the automobile lamp module include a condenser 1, three high-beam LED light sources 2, a low-beam LED light source 2, a reflector 5 and a lens 6, wherein the condenser 1 is made from a transparent material; the three high-beam LED light sources 2 and the low-beam LED light source 3 are arranged on a rear side, namely an incident light side, of the condenser (1); the reflector 5 is arranged on a front upper portion of the condenser (1); and the lens 6 is arranged on a front side of the condenser (1). The high-beam LED light source at a rear end of a block cavity structure (7) provided with an opening in an upper portion can be independently lit on or lit off.

The condenser (1) is made from PC with a refractivity of about 1.586 and has a light transmittance of about 0.88.

An auxiliary reflector 4 is arranged beside the low-beam LED light source (3).

The block cavity structure (7) provided with the opening in the upper portion is arranged on a left or right portion of the condenser (1).

The block cavity structure is an irregular quasi-quadrangle. An inner rear end face (7-1) and an inner middle end face (7-2) of the block cavity structure are flat faces. The inner rear end face of the block cavity structure is an incident light side. An outer front end face (1-3) of the condenser (1) is a flat face or an arc face. An inner front end face (7-3), namely the end face of the side close to the lens (6), of the block cavity structure is a flat face or an arc face, which is identical with the outer front end face of the condenser (1) and is matched with the outer front end face of the condenser (1).

An acute angle is formed at a joint of the inner rear end face (7-1) and the inner middle end face (7-2) of the block cavity structure on the condenser (1), so that a clear ADB cut-off line is formed.

At the rear end of the condenser (1), the high-beam LED light source corresponding to the block cavity structure (7) arranged on the left or right portion of the condenser (1) and provided with the opening in the upper portion is in a lit-up state when being in a full-high-beam working state, and light emitted thereby is transmitted by the block cavity structure and is then emitted forwards, so as to form a part of a high-beam light shape.

At the rear end of the condenser (1), the high-beam LED light source corresponding to the block cavity structure (7) arranged on the left or right portion of the condenser (1) and provided with the opening in the upper portion is in an off state when being in an ADB state, the other LED light sources are lit up, and light is fully reflected and is then emitted forwards after being irradiated on a side face of the block cavity structure, so as to form an ADB light shape.

Figure 3:
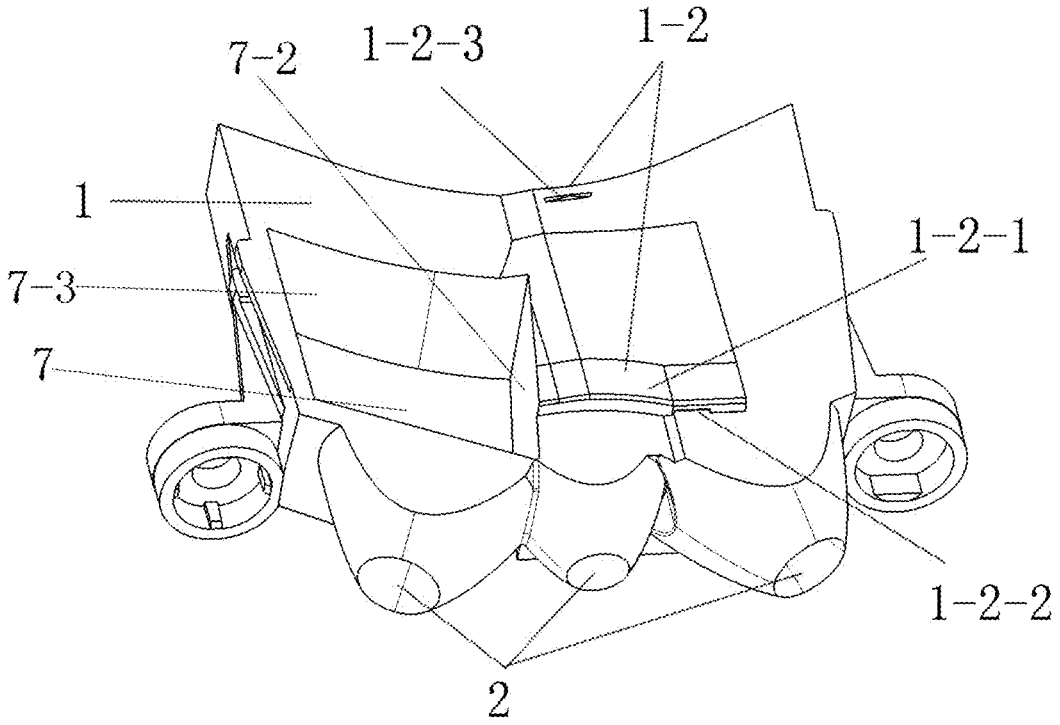
FIG. 3 is a perspective view of a condenser, applied to a left automobile lamp, of the LED light source high-beam and low-beam integrated automobile lamp module with the ADB function of the invention.
Figure 5:
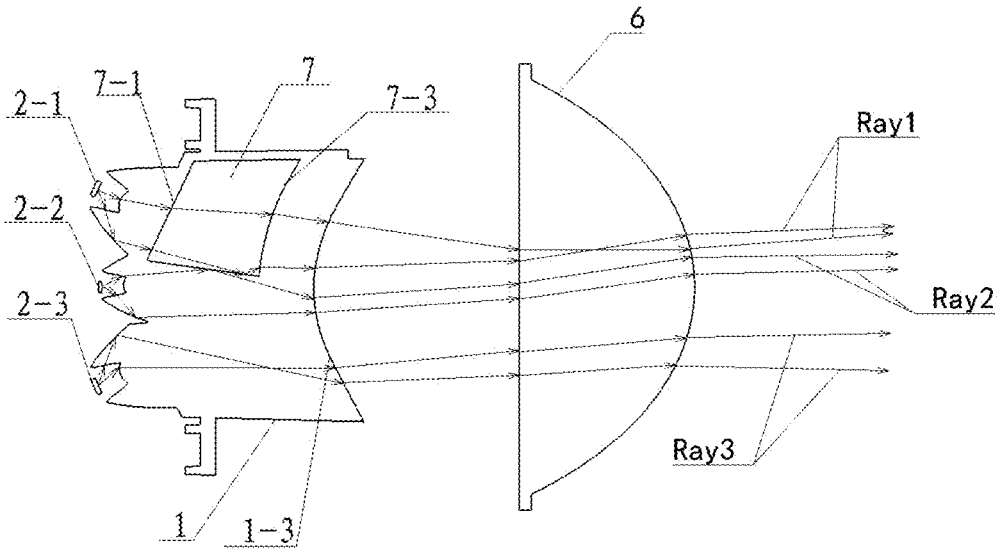
FIG. 5 is a direction view of full-high-beam light in the condenser of the LED light source high-beam and low-beam integrated automobile lamp module with the ADB function of the invention.
Figure 6:
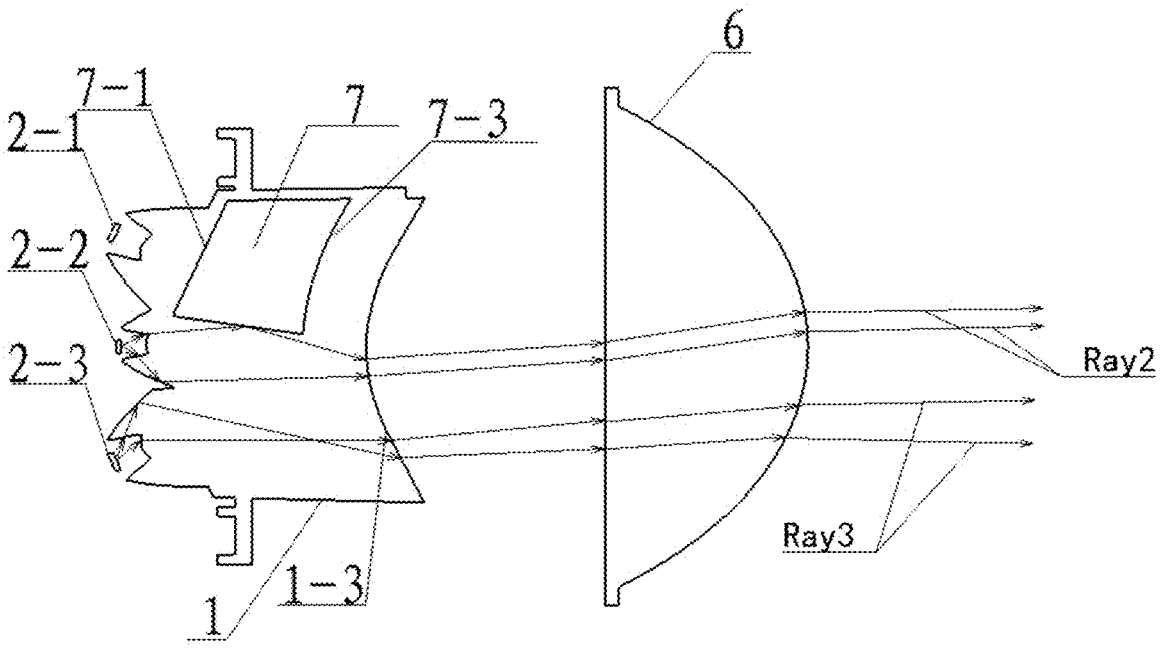
FIG. 6 is a direction view of ADB light in the condenser of the LED light source high-beam and low-beam integrated automobile lamp module with the ADB function of the invention.

As shown in FIGS. 3, 5 and 6, the condenser (1) is applied to a left automobile lamp, and the block cavity structure is arranged on a left side of the condenser corresponding to the left automobile lamp. In this way, when the block cavity structure is located on the left portion of the condenser, light emitted by the right high-beam LED light source is fully reflected on an inner side face, close to the middle of the condenser, of the block cavity structure on the left portion of the condenser.

Figure 4:
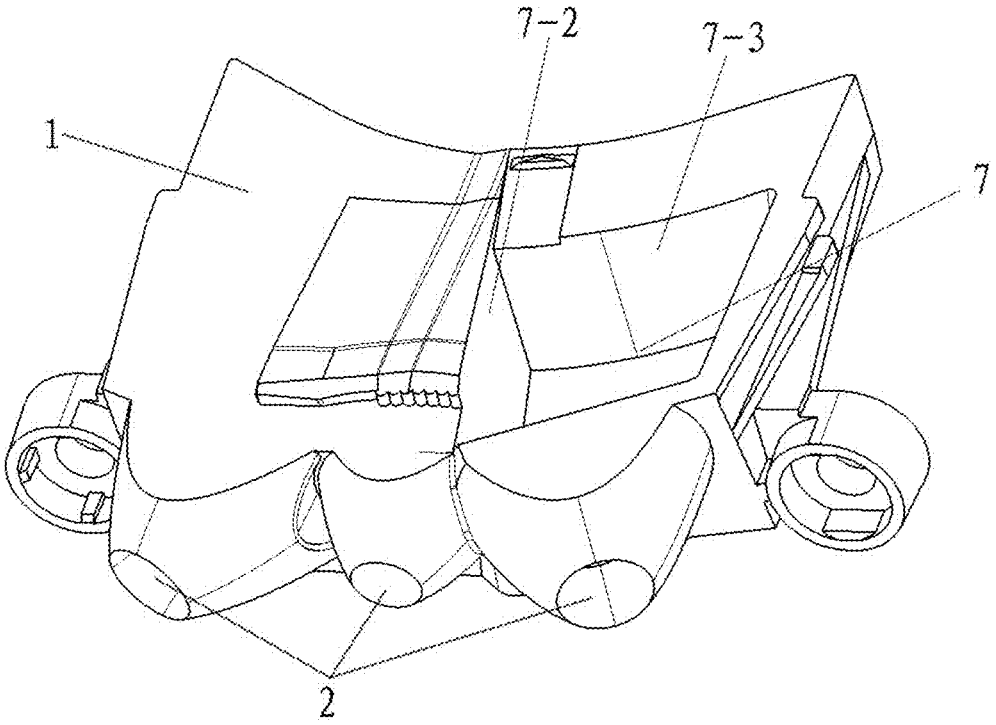
FIG. 4 is a perspective view of a condenser, applied to a right automobile lamp, of the LED light source high-beam and low-beam integrated automobile lamp module with the ADB function of the invention.

As shown in FIG. 4, the condenser (1) is applied to a right automobile lamp, and the block cavity structure is arranged on a right side of the condenser corresponding to the right automobile lamp. In this way, when the block cavity structure is arranged on the right portion of the condenser, light emitted by the left high-beam LED light source is fully reflected on an inner side face, close to the middle of the condenser, of the block cavity structure on the right portion of the condenser.

The condenser (1) is applied to a left or right automobile lamp, and when the number of the high-beam LED light sources (2) is an odd number such as 3 or 5, an inner side face, close to the middle of the condenser, of the block cavity structure is at least located on a left or right side of the axis of light emitted by the middle high-beam LED light source.

The distance from the inner front end face (7-3) of the block cavity structure on the left or right portion of the condenser (1) to the outer front end face (1-3) of the condenser is 2-10 mm.

The condenser (1) is made from transparent plastic or silica gel and is preferably made from PC.

The outer front end face of the condenser (1) is a concave arc face.

In addition, in this embodiment, an area III forming structure (1-2) is arranged on an upper portion of the condenser (1). The area III forming structure (1-2) comprises an area III breadth forming structure (1-2-1) and a 50 L dark area forming structure (1-2-3). Light forming an area III is reflected by the reflector and then enters the area III breadth forming structure (1-2-1) after being emitted by the low-beam LED light source.

An area III brightness reduction structure (1-2-2) in the shape of a square slot is formed in a lower edge of one side of the area III breadth forming structure (1-2-1) on the condenser (1) of the high-beam and low-beam integrated automobile lamp module. The brightness of a specific region of the area III can be reduced to 0.1 lx-0.7 lx during light distribution by adjusting the length, width, height and spatial position of the area III brightness reduction structure (1-2-2).

The 50 L dark area forming structure (1-2-3) is arranged in the light transmission direction and is in a convex triangle shape or in other shapes. The brightness of a 50 L area in a low-beam light shape can be controlled below a certain value by the 50 L dark area forming structure.

An end face of the area III breadth forming structure (1-2-1) is in a concave arc shape or in a convex arc shape.

In addition, an area III brightness reduction structure (1-2-2) in the shape of a rectangular slot is formed in a lower edge of one side of the area III breadth forming structure (1-2-1). The brightness of a local part of an area III in a low-beam light shape can be reduced by the area III brightness reduction structure (1-2-2), so that dazzling is prevented while sufficient illumination is provided by a low beam.

The area III brightness reduction structure specifically has a length of about 2.8 mm, a width of about 0.4 mm and a height of about 0.3 mm and is used for reducing the brightness of a local part of an area III in the low-beam light shape.

The condenser is used to light up a left or right automobile lamp and thus is generally installed on the automobile lamp in use.

As shown in FIG. 3, the condenser (1) is located in the left automobile lamp, and the block cavity structure is located on a left side of the emergent light direction under the top view of the module, wherein the emergent light direction refers to the direction from the second high-beam LED light source to the lens 6.

As shown in FIG. 4, the condenser 1 is located in the right automobile lamp, and the block cavity structure is arranged on a right side of the emergent light direction under the top view of the module.

Figure 7:
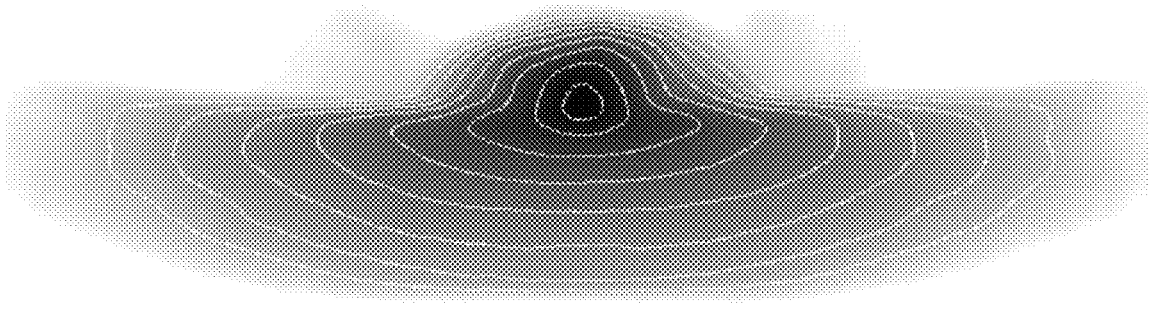
FIG. 7 is a diagram of a full-high-beam light shape of the LED light source high-beam and low-beam integrated automobile lamp module with the ADB function of the invention.
Figure 11:
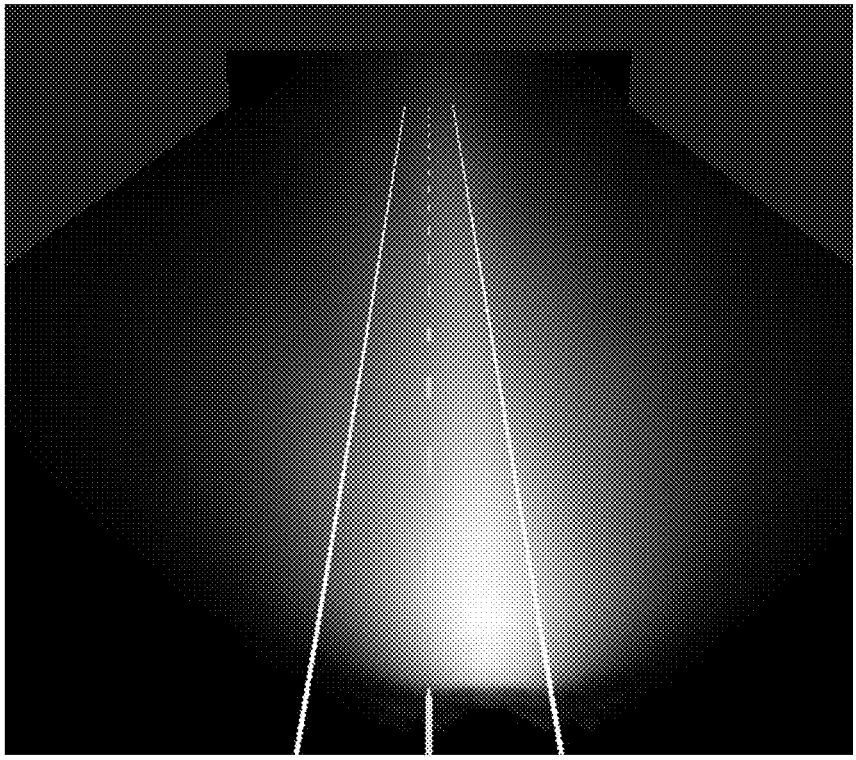
FIG. 11 is a pavement effect picture of the LED light source high-beam and low-beam integrated automobile lamp module with the ADB function in a full-high-beam working state.

As shown in FIG. 5, the LED light source (2-1) corresponding to the rear end of the block cavity structure on the condenser (1) is in a lit-up state when being in a full-high-beam working state, and light emitted thereby is transmitted by the block cavity structure and is then emitted forwards so as to form a part of a high-beam light shape and is combined with light emitted by the other two LED light sources (2-2) and (2-3) to form full-high-beam light. The light shape of the full-high-beam light is shown in FIG. 7, and the corresponding pavement effect picture is shown in FIG. 11. In this case, the pavement is completely illuminated, and good visibility is realized.

Figure 8:
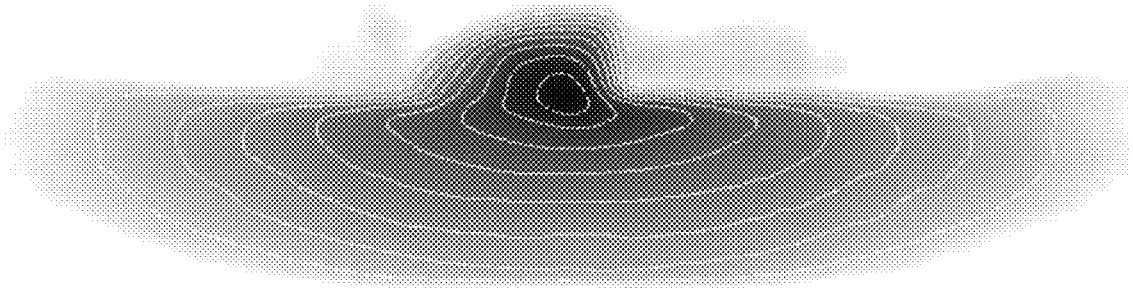
FIG. 8 is a diagram of an ADB light shape, applied to a left automobile lamp, of the LED light source high-beam and low-beam integrated automobile lamp module with the ADB function of the invention.
Figure 9:
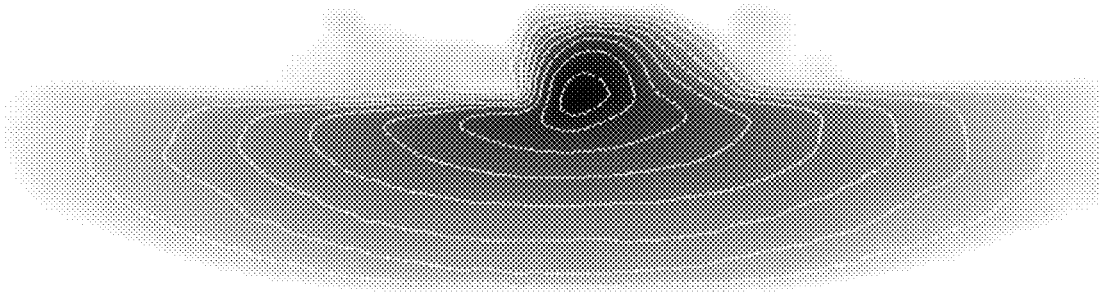
FIG. 9 is a diagram of an ADB light shape, applied to a right automobile lamp, of the LED light source high-beam and low-beam integrated automobile lamp module with the ADB function of the invention.
Figure 10:
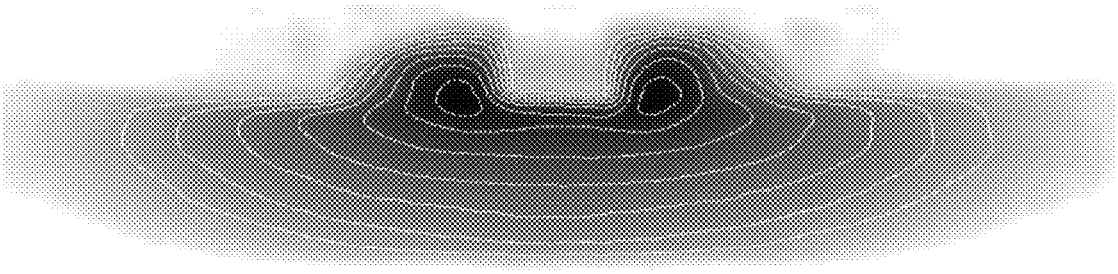
FIG. 10 is a diagram of an overlapped ADB light shape, applied to the left automobile lamp and the right automobile lamp, of the LED light source high-beam and low-beam integrated automobile lamp module with the ADB function in an ADB working state of the invention.
Figure 12:
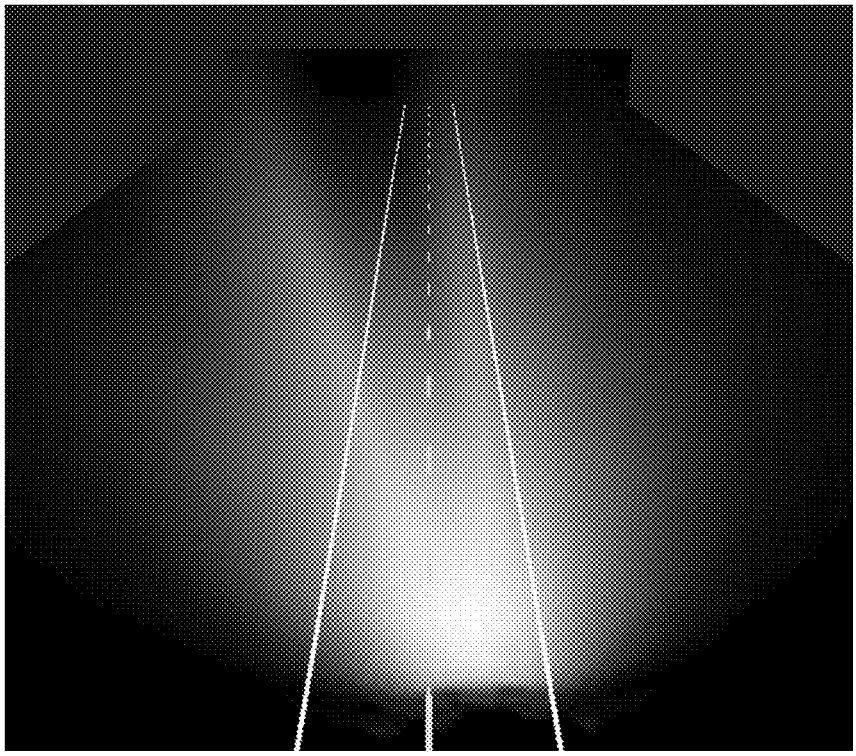
FIG. 12 is a pavement effect picture of the LED light source high-beam and low-beam integrated automobile lamp module with the ADB function in an ADB working state.
Figure 13:
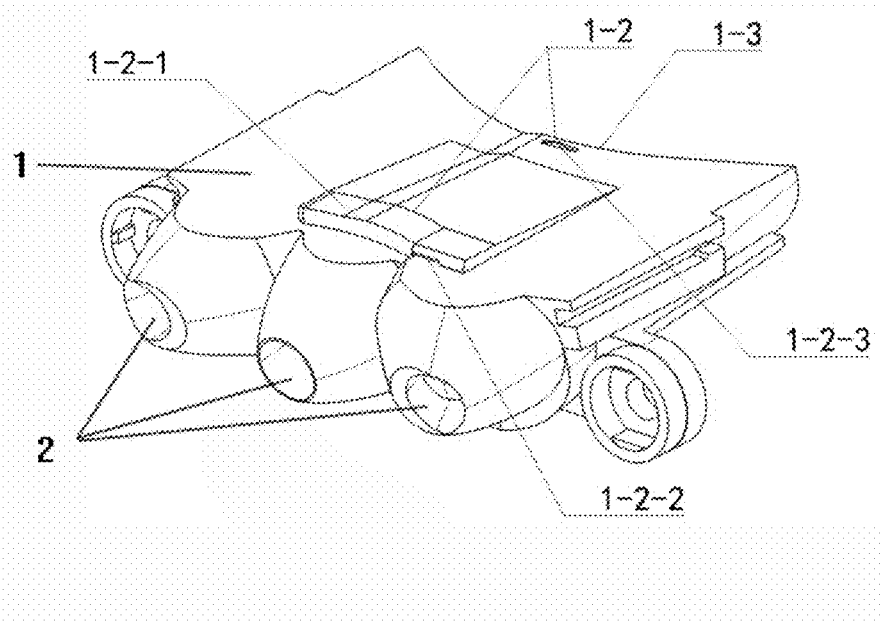
FIG. 13 is view of an area III forming structure (1-2) adopted by the LED light source high-beam and low-beam integrated automobile lamp module with the ADB function of the invention.

As shown in FIG. 6, the LED light source corresponding to the rear end of the block cavity structure on the condenser (1) is in an off state when being in an ADB working state, the other two LED light sources are lit up, and light is fully reflected and is then emitted forwards after being irradiated on a side face of the block cavity structure, so as to form an ADB light shape. The ADB light shape of the left automobile lamp is shown in FIG. 8, the ADB light shape of the right automobile lamp is shown in FIG. 9, and the overlapped light shape of the left automobile lamp and the right automobile lamp in the ADB working state is shown in FIG. 10, wherein a concave area in the middle is a dark area formed for protecting a vehicle from the opposite direction against dazzling, and the size of the dark area can be adjusted by rotating the module in the left or right automobile lamp leftwards or rightwards so as to adapt to different illumination ranges. The pavement effect picture in the ADB working state is shown in FIG. 12. As shown in FIG. 12, the automobile has a good illumination effect when running on a two-way lane, and the driver of an automobile from the opposite direction is protected against dazzling, so that the driving safety is improved.

What is claimed is:

1. An LED light source high-beam and low-beam integrated automobile lamp module with an ADB function, comprising:

a condenser (1) made from a transparent material;

high-beam LED light sources (2) and a low-beam LED light source (3), which are arranged on a rear side, namely an incident light side, of the condenser (1);

a reflector (5) and a lens (6) which are respectively arranged on a front upper portion of the condenser (1), namely a front upper portion of an emergent light side, and a front side of the condenser (1); characterized in that:

a block cavity structure (7) provided with an opening in an upper portion is arranged on a left or right portion of the condenser (1);

the block cavity structure is a quasi-polygon;

an inner rear end face (7-1) and an inner middle end face (7-2) of the block cavity structure are flat faces, and the inner rear end face of the block cavity structure is the incident light side;

an outer front end face (1-3) of the condenser (1) is a flat face or an arc face;

the inner front end face (7-3), namely an end face of a side close to the lens (6), of the block cavity structure is a flat face or an arc face, which is identical with the outer front end face of the condenser (1) in shape and is matched with the outer front end face of the condenser (1).

2. The LED light source high-beam and low-beam integrated automobile lamp module with the ADB function according to claim 1, wherein:

an acute angle is formed at a joint of the inner rear end face (7-1) and the inner middle end face (7-2) of the block cavity structure on the condenser (1), so that a clear ADB cut-off line is formed.

3. The LED light source high-beam and low-beam integrated automobile lamp module with the ADB function according to claim 1, wherein:

the number of the high-beam LED light sources (2) is 2-5.

4. The LED light source high-beam and low-beam integrated automobile lamp module with the ADB function according to claim 1, wherein:

of all the high-beam LED light sources (2), the high-beam LED light source located at a rear end of the block cavity structure (7) arranged on the condenser and provided with the opening in the upper portion can be independently lit up or off.

5. The LED light source high-beam and low-beam integrated automobile lamp module with the ADB function according to claim 4, wherein:

at a rear end of the condenser (1), the high-beam LED light source corresponding to the block cavity structure (7) located on the condenser (1) and provided with the opening in the upper portion is in a lit-up state when being in a full-high-beam working state, and light emitted thereby is transmitted by the block cavity structure and is then emitted forwards, so as to form a part of a high-beam light shape;

at the rear end of the condenser (1), the high-beam LED light source corresponding to the block cavity structure located on the condenser (1) and provided with the opening in the upper portion is in an off state when being in an ADB working state, the other LED light sources are lit up, and light is full reflected and is then emitted forwards after being irradiated on a side face of the block cavity structure, so as to form an ADB light shape.

6. The LED light source high-beam and low-beam integrated automobile lamp module with the ADB function according to claim 1, wherein:

the condenser (1) is applied to a left automobile lamp, and the block cavity structure is arranged on a left portion of the condenser corresponding to the left automobile lamp.

7. The LED light source high-beam and low-beam integrated automobile lamp module with the ADB function according to claim 1, wherein:

the condenser (1) is applied to a right automobile lamp, and the block cavity structure is arranged on a right portion of the condenser corresponding to the right automobile lamp.

8. The LED light source high-beam and low-beam integrated automobile lamp module with the ADB function according to claim 1, wherein:

the condenser (1) is applied to a left or right automobile lamp, and when the number of the high-beam LED light sources (2) is an even number such as 2 or 4, an inner side face, close to a middle of the condenser, of the block cavity structure is at least located on a left or right side of a midline between two said high-beam LED light sources (2);

in this way, when the block cavity structure is arranged on the right portion of the condenser, light emitted by the left high-beam LED lamp source is fully reflected by the inner side face, close to the middle of the condenser, of the block cavity structure on the right portion of the condenser; or when the block cavity structure is arranged on the left portion of the condenser, light emitted by the right high-beam LED light source is fully reflected by the inner side face, close to the middle of the condenser, of the block cavity structure on the left portion of the condenser.

9. The LED light source high-beam and low-beam integrated automobile lamp module with the ADB function according to claim 1, wherein:

the condenser (1) is applied to a left or right automobile lamp, and when the number of the high-beam LED light sources (2) is an odd number such as 3 or 5, an inner side face, close to a middle of the condenser, of the block cavity structure is at least located on a left or right side of an axis of light emitted by the middle high-beam LED light source;

in this way, when the block cavity structure is arranged on the right portion of the condenser, light emitted by the middle high-beam LED light source is fully reflected by the inner side face, close to the middle of the condenser, of the block cavity structure on the right portion of the condenser; or when the block cavity structure is arranged on the left portion of the condenser, light emitted by the middle high-beam LED light source is fully reflected by the inner side face, close to the middle of the condenser, of the block cavity structure on the left portion of the condenser.

10. The LED light source high-beam and low-beam integrated automobile lamp module with the ADB function according to claim 1, wherein:

when the condenser (1) is applied to a left or right automobile lamp, a distance from the inner front side face of the block cavity structure on the left or right portion of the condenser to the outer front end face (1-3) of the condenser is 2-10 mm.

11. The LED light source high-beam and low-beam integrated automobile lamp module with the ADB function according to claim 1, wherein:

the block cavity structure on the condenser (1) is an irregular quasi-square hole.

12. The LED light source high-beam and low-beam integrated automobile lamp module with the ADB function according to claim 1, wherein:

the block cavity structure on the condenser (1) is an irregular quasi-rectangular hole.

13. The LED light source high-beam and low-beam integrated automobile lamp module with the ADB function according to claim 1, wherein:

the outer front end face of the condenser (1) is a concave arc face.

* * * * *